US005082279A

United States Patent [19]

Hull et al.

[11] Patent Number: 5,082,279

[45] Date of Patent: Jan. 21, 1992

[54] LIQUID FILLED GOLF CLUB

[76] Inventors: Harold L. Hull, 701 Canyon Way #43, Sparks, Nev. 89434; Dennis J. Waite, 2245 Hedgewood Dr., Reno, Nev. 89509

[21] Appl. No.: 552,481

[22] Filed: Jul. 16, 1990

[51] Int. Cl.[5] ..... A63B 53/08; A63B 69/36

[52] U.S. Cl. ..... 273/170; 273/171; 273/DIG. 14

[58] Field of Search ..... 273/77 R, 170, 171, 273/193 R, 194 R, 186 A, 73 E, DIG. 14, 169

[56] References Cited

U.S. PATENT DOCUMENTS

| | | | |
|---|---|---|---|
| 1,561,595 | 11/1925 | Davis | 273/170 |
| 1,894,841 | 1/1933 | Adams | 273/170 |
| 2,432,450 | 12/1947 | Sears | 273/171 |
| 2,644,890 | 7/1953 | Hollihan | 273/DIG. 14 X |
| 3,037,775 | 6/1962 | Busch | 273/171 |
| 3,199,874 | 8/1965 | Blasing | 273/170 |
| 3,215,437 | 11/1965 | Webb | 173/186 |
| 3,516,673 | 6/1970 | Estes | 273/170 X |
| 3,993,314 | 11/1976 | Harrington et al. | 273/170 |
| 4,085,934 | 4/1978 | Churchward | 273/171 |
| 4,423,873 | 1/1984 | Shiratori | 273/DIG. 14 X |
| 4,541,631 | 9/1985 | Sasse | 273/170 |
| 4,655.458 | 4/1987 | Lewandowski | 273/170 |
| 4,715,606 | 12/1987 | Varley | 273/170 X |
| 4,730,830 | 3/1988 | Tilley | 273/171 |

FOREIGN PATENT DOCUMENTS

| | | | |
|---|---|---|---|
| 971197 | 7/1975 | Canada | 273/170 |
| 4784 | 11/1908 | United Kingdom | 273/170 |
| 4485561 | 6/1936 | United Kingdom | 273/170 |
| 2200560 | 8/1988 | United Kingdom | 273/171 |

*Primary Examiner*—Banjamin Layno
*Assistant Examiner*—Sebastiano Passaniti

[57] ABSTRACT

A golf club that is substantially hollow and partially filed with a viscous fluid or other flowable material such as ball-bearings or sand and has multiple compartments to capture the weight in different sections to change the weight of the club at the golf head or handle.

12 Claims, 3 Drawing Sheets

FIG 1
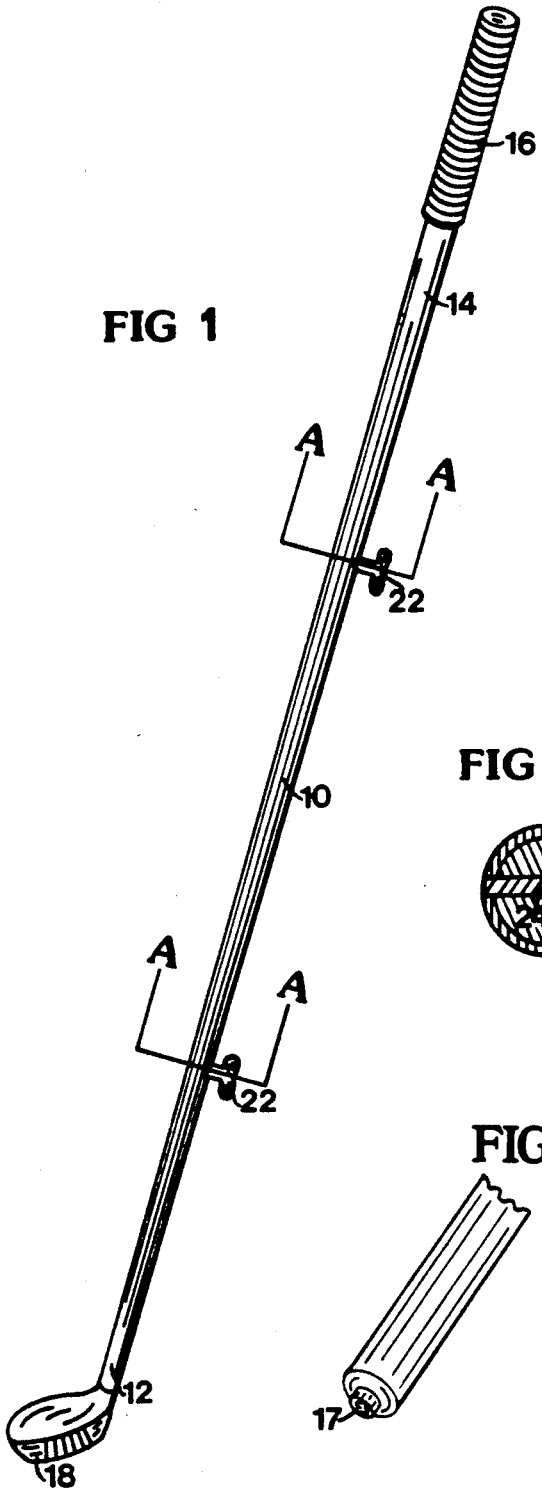
FIG 2
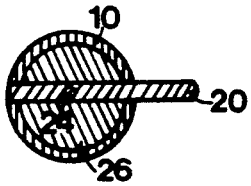
FIG 4
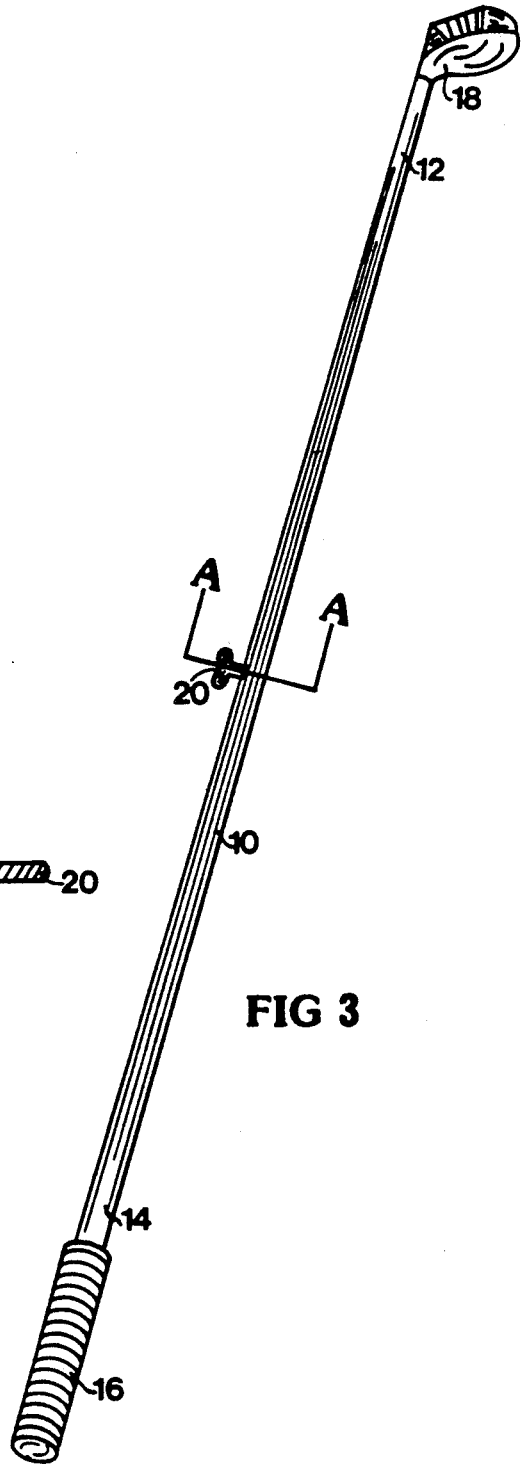
FIG 3

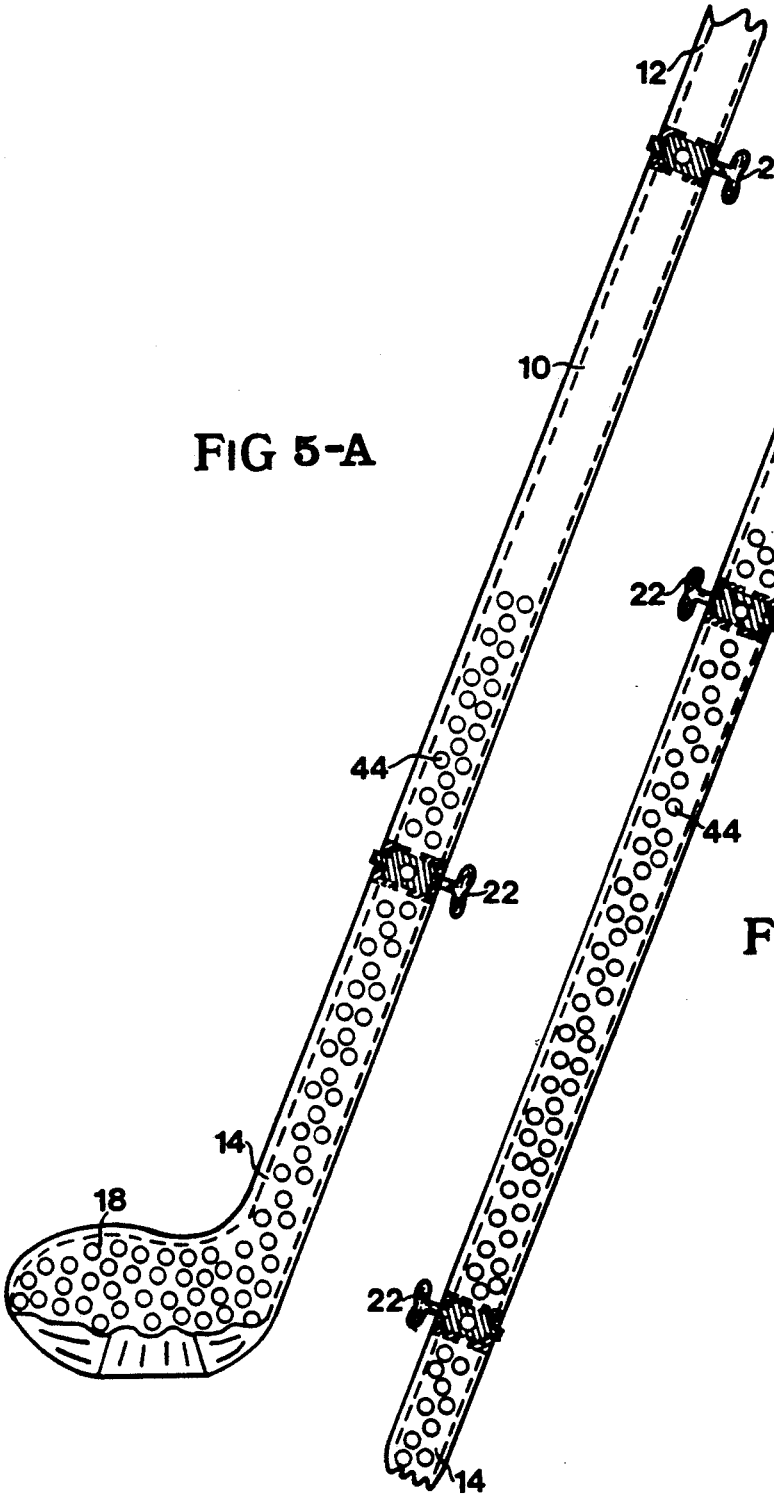
FIG 5-A
FIG 5-B

FIG 6
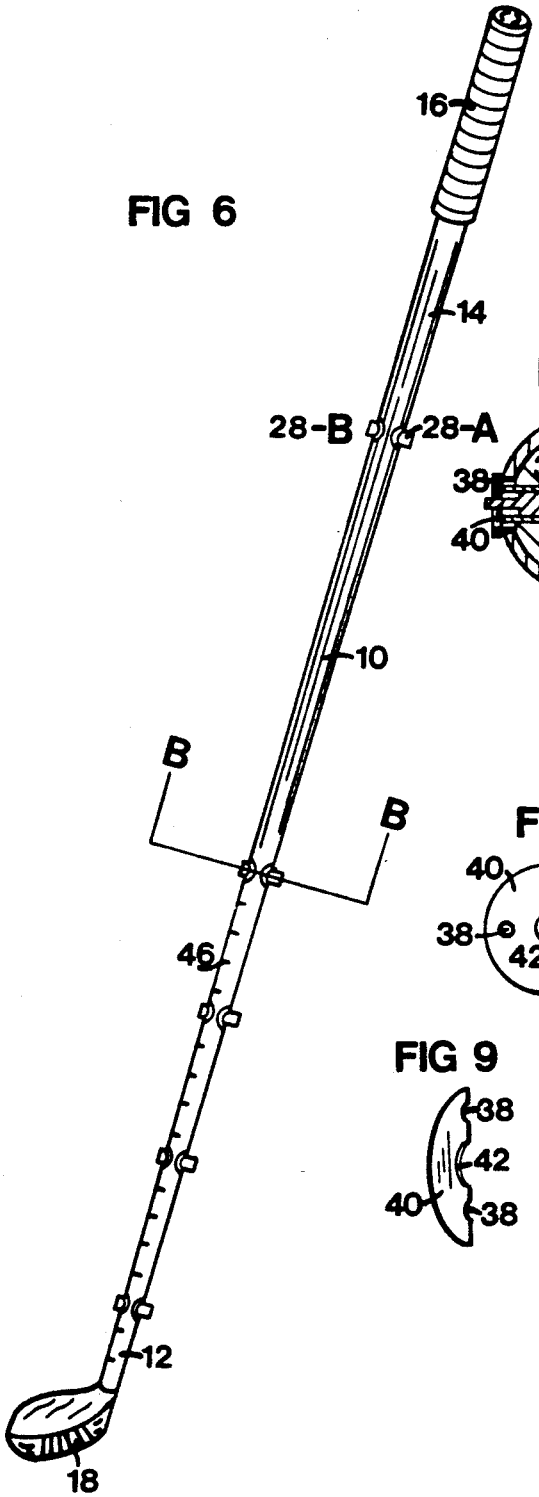
FIG 7
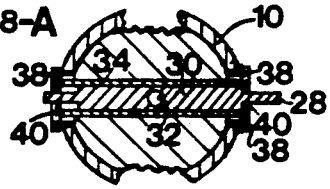
FIG 8
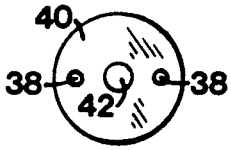
FIG 9
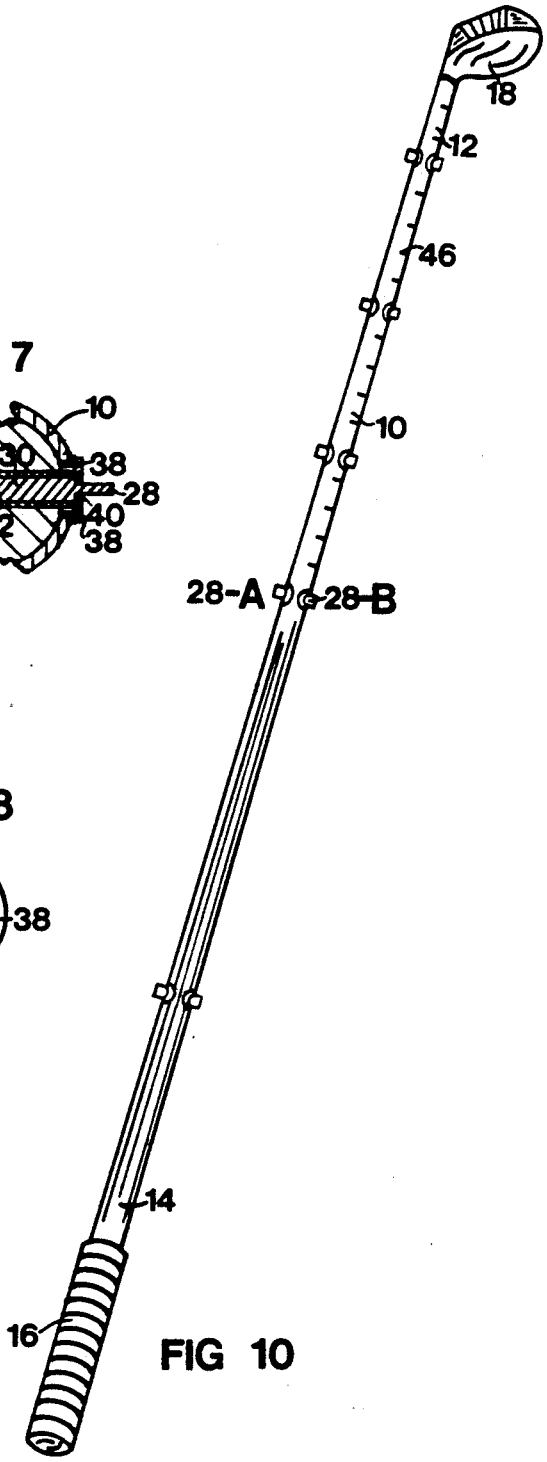
FIG 10

LIQUID FILLED GOLF CLUB

This invention relates to golf clubs but more particularly to golf clubs which are filled with a flowable material for improved weight distribution.

BACKGROUND OF THE INVENTION

In the past, several liquid filled golf clubs have been taught, such as U.S. Pat. Nos. 4,655,458 and 3,199,874 wherein they teach a mercury filled golf club head.

U.S. Pat. No. 4,730,830 teaches a hollow head which is filled with a liquid plastic material, such as epoxy resin.

In the above mentioned patents no where do they teach (known to the inventors) a handle and golf club head filled with liquid or a flowable material as does the present invention.

The present invention is new and unusual in manner due to the fact that it provides the user with variable weight distribution by employing multiple valves which are located at predetermined positions along the handle section of the golf club, whereby the amount of flowable material allowed to flow to the golf club head, or sections of the golf club handle is regulated and captured by the multiple valves.

SUMMARY OF THE INVENTION

It is the primary object of the present invention to provide a golf club which will allow the user to adjust the distribution of the weight of the club handle and head simply and effectively without the use of additional weights nor any added parts, due to the fact that the weight in the golf club handle and golf club head is adjustable by capturing a flowable material such as a liquid (such as water or anti-freeze) or flowable material (such as ball-bearings or sand) or other viscous material in compartments in the handle and/or the golf club head.

A further object of the present invention is to provide a golf club handle which is transparent, whereby the user can easily see into the hollow golf club and visually adjust the liquid level.

Yet another object of the present invention is to provide a golf club which is designed with multiple valves, wherein, flowable material distribution is variable.

Still another object of the present invention is to provide a practice golf club with variable head and/or handle weight which exercises the proper muscles, which will improve the golfers swing.

Another object of the present invention is to provide a golf club handle on which predetermined, horizontal, equally spaced markings are located, with these markings representing different weight distribution. Traditionally the distance a golf ball will be propelled depends on the loft of the golf club head, however, with the present invention, the distance the golf ball will be propelled depends on the loft of the golf ball head as well as the distribution of its weight, therefore if the user desires to make a shot wherein he estimates the distance to be driven will require more than a five iron but not quite a six iron, then the user can adjust the weight distribution throughout the golf club handle and head, whereby, when the golf club (with a five iron head) with added weight, strikes the ball, the golf ball will be propelled a farther distance than with a normal five iron. The five iron in this case is used only as an example. Any golf club made in accordance with the present invention will have variable weight control, whereby, we have provided new and unusual results which improve the users individual skills.

Yet another object of the present invention is to provide a golf club which is completely hollow from its closed handle end throughout the golf club head, wherein, this hollow section is water-tight and partially filled with liquid or other flowable material.

Another object of the present invention is to provide a golf club wherein, the flowable material used to partially fill the hollow section has color, whereby the level is easy to see and is pleasing to the eye.

Other objects and advantages will become apparent when taken into consideration with the following drawings and specifications.

BRIEF DESCRIPTION OF THE DRAWINGS

FIG. 1 is a perspective view which shows on embodiment while in an upright position.

FIG. 2 is a section taken at one of the sections at A—A of FIGS. 1 and 3.

FIG. 3 is a perspective view which shows one embodiment while in an inverted position.

FIG. 4 is a perspective view of a filling means.

FIG. 5-A is a cut-away, elevation view which shows the flowable material level, while in an upright position.

FIG. 5-B is a cut-away, elevation view which shows the flowable material level, while in an inverted position.

FIG. 6 is a perspective view of the preferred embodiment.

FIG. 7 is a section taken at B—B of FIG. 6.

FIG. 8 is a top view of FIG. 7.

FIG. 9 is a perspective side view of FIG. 8.

FIG. 10 is a perspective view of the preferred embodiment while in an inverted position.

DETAILED DESCRIPTION OF THE DRAWINGS

Referring now in detail to the drawings wherein like numerals represent like parts, 10 is an elongated, cylindrical, hollow tube with its base section 12 being of a circumference less than that of its distal end section 14. 16 is a hand grip which is suitably attached to the end section 14, 17 being a filling means such as a plug, while 18 is a typical golf club head which is an integral part and is suitably attached to the base section 12, 20 being a cylindrical two position turn valve substantially located in the center section of hollow tube 10, while 22 being a cylindrical two position turn valve substantially located at points of tube 10 which substantially divides tube 10 into three equal sections, 24 being a hole substantially located in the center section of valves 20 and 22. 26 is a housing for valves 20 and 22. FIG. 7 illustrates a valve assembly comprising; a slidable shaft 30 which has an open and closed position, is frictionally engaged and encased in a housing 34, housing 34 having a port opening (not shown) which cooperates with transverse opening 32 when 32 is in its open position, slidable shaft 30 having transverse opening 32, located substantially in its center and having on its ends abutments, substantially in the form of buttons 28-A and 28-B with the valve assembly, when installed in the tube 10, lying transverse to the swing of the golf club.

When the button 28-A is depressed, the opening 32 aligns with port opening (not shown) whereby creating an open position and a space wherein viscous fluid 44 or a flowable material (such as ball-bearings or sand) can freely flow through port opening (not shown) and transverse opening 32. 40 is a cover plate which holds buttons 28-A and 28-B secure against tube 10 by attaching means such as screws (not shown) through screw holes 38. Cover plate 40 has substantially at its center a hole 42, which will allow buttons 28-A and 28-B to be incircled and embraced so that the cover plate 40 can be easily slipped over buttons 28-A and 28-B and become nearly flush with tube 10 Tube 10 and golf club head 18 being an intregal part thereof is hollow, completely sealed and partially filled with viscous fluid 44 or a flowable material and located along tube 10 are horizontal, predetermined, equally spaced markings 46.

MODE OF OPERATION

It will now be seen that we have provided a golf club wherein the user may adjust and capture the amount of weight distributed to any desired location along tube 10 and/or golf club head 18. For example the user desires to make a relatively long shot, therefore, it would be advantageous to use a greater weight at the golf head so as to apply a greater force against the golf ball, whereby the golf ball will be propelled a greater distance, therefore, the user desires to have most of the weight distributed toward the golf club head 18, which is the contact point for a golf ball (not shown). To achieve this desired effect the user simply turns valves 20 or 22 into a vertical axis (while the golf club is in a vertical position) as shown in FIG. 1, whereby creating an open position for valves 20 or 22, or in the preferred embodiment (shown in FIG. 6 and 10) buttons 28-A and 28-B are used, whereby the user simply pushes buttons 28-A (while the golf club is in a vertical position) as shown in FIG. 6, therefore creating an open position for slidable valve 30 which aligns with port opening (not shown) and allows the vicious fluid 44 or flowable material to flow freely in a downward direction toward golf club head 18. As a result of this action approximately ⅓ of the golf club which contains golf club head 18, base section 12, and a partial section of tube 10, is now heavier than the remaining section of tube 10 due to the added weight of the vicious fluid 44 or flowable material. The user now simply turns valves 20 or 22 into a horizontal axis, whereby, creating a closed position for valves 20 or 22, or in the preferred embodiment (shown in FIG. 6 and 10) button 28-B is pressed, whereby creating a closed position for slidable shaft 30, therefore, the viscous fluid 44, or flowable material, is now captured in its present location and the desirable weight distribution has been achieved.

It will also be seen that if the user desires to make a shot of a lesser distance than the previous shot, then it would be advantageous to have less weight distributed toward the golf ball head 18, this is simply achieved by turning the golf club upside down (as illustrated in FIG. 3 and 5) and again turning valves 20 or 22 into a vertical axis, whereby creating an open position for valves 20 or 22, or in the preferred embodiment (shown in FIG. 6 and 10) while the golf club is in an upside down position (as shown in FIG. 10) wherein buttons 28 are used, the user simply presses buttons 28-A, whereby creating an open position for slidable shaft 30, while cooperating with port opening (not shown) and transverse opening 32, this will allow all of the vicious fluid 44 or flowable material to flow freely toward the hand grip 16. As a result of this action, approximately ⅓ of the golf club which contains hand grip 16, distal end section 14, and a partial section of tube 10 is now heavier than the remaining section of tube 10 due to the added weight of the viscous fluid 44 or a flowable material, the desired result has been achieved, therefore the user wishes for the viscous fluid 44 or flowable material to remain in its present location, this is achieved simply by turning valves, 20 and 22 into a horizontal axis whereby, creating a closed position for valves 20 and 22, or in the preferred embodiment (shown in FIG. 6 and 10) buttons 28-B are pressed, whereby creating a closed position for slidable shaft 30, therefore, the viscous fluid 44 or flowable material is now captured in its present location and the desirable weight distribution has been achieved.

It will further be noted that various combinations of weight distribution can be achieved by simply operating one of the valves 22 (shown in FIG. 1) as described above, or in the preferred embodiment (shown in FIG. 6 and 10) operating only one or several of the buttons 28 as described above, whereby, variable weight distribution is completely controllable for the skilled individual, wherein, weight distribution is determined by the users own discretion and the user can decide the proper weight distribution for his own individual needs.

It will now bee seen that we have provided a golf club wherein, variable weight distribution is easily adjustable by the individual golfer. The golf club is transparent, completely hollow, water-tight and filled with a viscous fluid or flowable material which may have color. Along the handle section of the golf club are valves or buttons and predetermined, horizontal, equally spaced markings.

It will also be seen that this golf club may be used for practice purposes to improve the golfers swing and muscle tone, or it may be used by the serious golfer to improve their performance on the golf course.

Although the invention has been herein shown and described in what is conceived to be the most practical and preferred embodiments, it is recognized that departures may be made therefrom, within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A hollow, sealed golf club comprising; an elongated, cylindrical, transparent hollow tube, said tube having filling means, a hand grip, said hand grip having means to attach said hand grip to a proximate end of said tube, a hollow golf club head, said hollow golf club head having means to attach said club head to a distal end of said tube opposite said proximate end, said tube and said golf club head being internally connected and partially filled with a flowable material, said tube having at least two externally controlled valve means, said valve means separating said tube and said head into at least three compartments, said valve means having a first and second position, said first position allowing said flowable material to pass through said valves, said second position not allowing said flowable material to pass through said valves, said transparent tube having indicia to indicate the proportions of said flowable material in each of said compartments; said filling means, said hand grip, said hollow golf club head, said externally controlled valve means, said compartments, said indicia and said flowable material cooperating together to allow said flowable material to be captured in visible variable proportions in said compartments.

2. The device of claim 1 in which said means to attach said hand grip to said hollow tube is by friction.

3. The device of claim 1 in which said filling means is a closable opening in the proximate end of said hollow tube.

4. The device of claim 3 in which said closable opening is a plug.

5. The device of claim 1 in which said means to attach said hollow golf club head to said hollow tube is by bonding.

6. The device of claim 1 in which said flowable material is water.

7. The device of claim 1 in which said flowable material is sand.

8. The device of claim 1 in which said flowable material is anti-freeze.

9. The device of claim 1 in which said flowable material comprises ball-bearings.

10. The device of claim 1 in which said valve means is a cylindrical, two position turn valve.

11. The device of claim 1 in which said valve means is a two position slide valve.

12. The device of claim 1 in which said flowable material has a distinct color.

* * * * *